United States Patent [19]

Boarini

[11] 3,965,639

[45] June 29, 1976

[54] BEAM-REINFORCED CEILING PANELS

[75] Inventor: Edward J. Boarini, Arlington Heights, Ill.

[73] Assignee: United States Gypsum Company, Chicago, Ill.

[22] Filed: Feb. 3, 1975

[21] Appl. No.: 546,220

Related U.S. Application Data

[63] Continuation of Ser. No. 383,210, July 27, 1973, abandoned, which is a continuation of Ser. No. 167,198, July 29, 1971, abandoned.

[52] U.S. Cl. ..... 52/629; 52/483; 52/496; 52/498

[51] Int. Cl.[2] ..... E04C 2/38

[58] Field of Search ..... 52/483, 498, 492, 490, 52/494, 496, 497, 600, 601, 602, 629

[56] References Cited

UNITED STATES PATENTS

| | | | |
|---|---|---|---|
| 1,751,923 | 3/1930 | Kane | 52/629 |
| 1,937,177 | 11/1933 | Villadsen et al. | 52/483 |
| 2,009,960 | 7/1935 | Johnson | 52/483 |
| 2,767,440 | 10/1956 | Nelsson | 52/488 |
| 2,993,240 | 7/1961 | Ericson | 52/496 |
| 3,100,319 | 8/1963 | Carlson | 52/496 |
| 3,193,885 | 7/1965 | Gartner et al. | 52/36 |
| 3,557,513 | 1/1971 | Girard | 52/475 |
| 3,608,266 | 9/1971 | Satkin et al. | 52/122 |
| 3,638,370 | 2/1972 | Miller | 52/36 |
| 3,686,810 | 8/1972 | Allen | 52/488 X |

FOREIGN PATENTS OR APPLICATIONS

| | | | |
|---|---|---|---|
| 843,055 | 6/1970 | Canada | 52/496 |
| 354,366 | 4/1905 | France | 52/629 |
| 1,381,927 | 11/1964 | France | 52/494 |
| 642,520 | 9/1950 | United Kingdom | 52/404 |
| 675,591 | 7/1952 | United Kingdom | 52/483 |

*Primary Examiner*—Ernest R. Purser
*Assistant Examiner*—Leslie A. Braun
*Attorney, Agent, or Firm*—Donnie Rudd; Samuel Kurlandsky; Kenneth E. Roberts

[57] ABSTRACT

An extra-wide ceiling panel and ceiling constructed therefrom characterized by a reinforcing member extending along the back surface thereof, the member being generally flat with negligible vertical extension so as not to interfere with the stacking of such panels. Means are provided for further reinforcing the member with a beam characterized by extending generally perpendicular to the reinforcing member.

3 Claims, 10 Drawing Figures

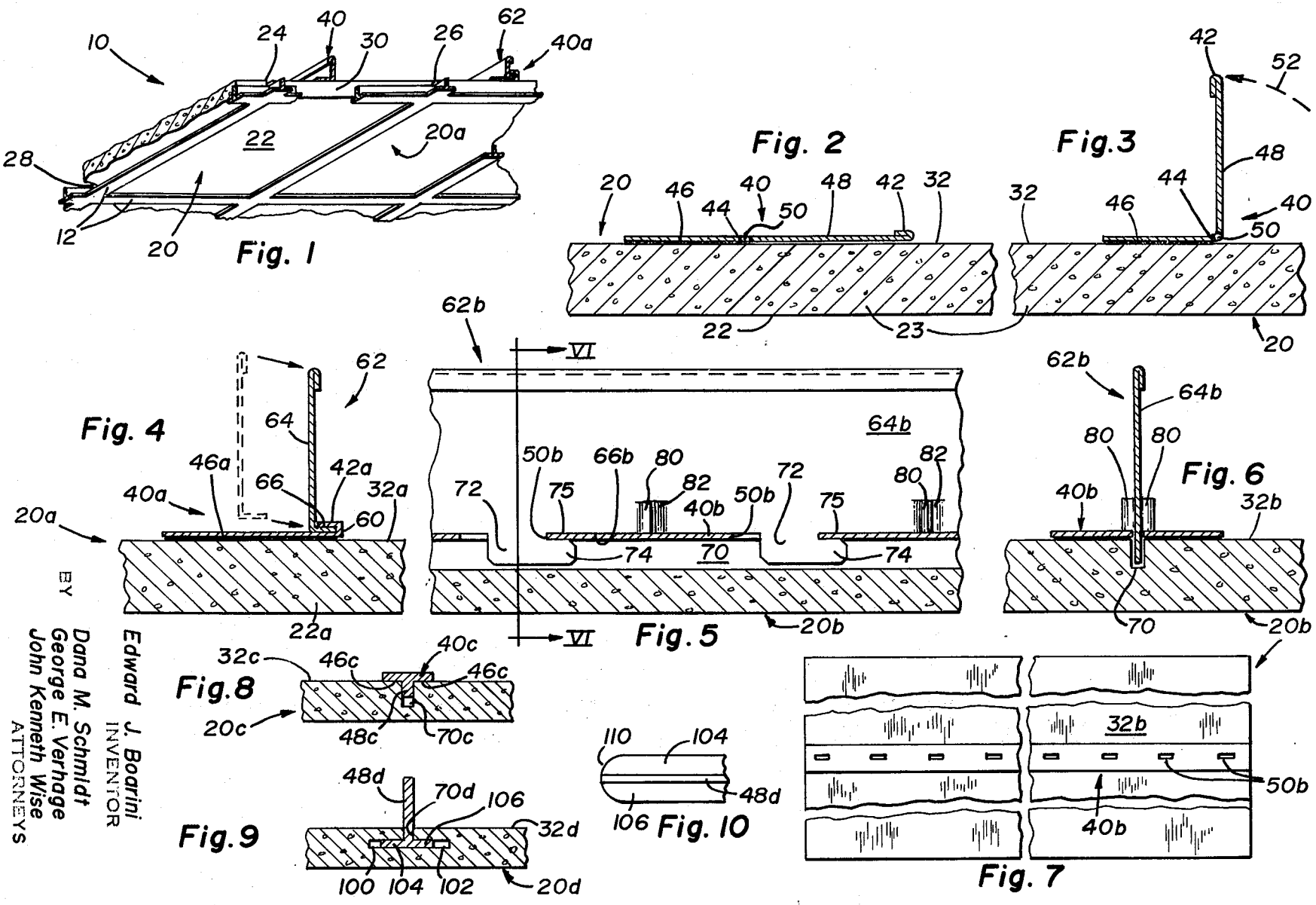
Edward J. Boarini
INVENTOR
BY Dana M. Schmidt
George E. Verhage
John Kenneth Wise
ATTORNEYS

BEAM-REINFORCED CEILING PANELS

This is a continuation of application Ser. No. 383,210, filed July 27, 1973, now abandoned, which itself is a continuation application of U.S. application Ser. No. 167,198, filed on July 29, 1971, now abandoned.

BACKGROUND OF THE INVENTION

Lay-in ceiling tile or panels formed from various aggregates such as clay and mineral wool have for a long time been limited to a size which will not sag during a long period of use. The conventional limit to this size has been about two by four feet. Sizes larger than this have until recently resulted in noticeable sag, regardless of the particular aggregate which has been used in making the panels. The support of the tile has conventionally been at the edges only, as shown in U.S. Pat. No. 751, a representative ceiling construction.

A recent attempt to overcome the problem involved the use of a spine attached on the site to the back of each ceiling panel, by driving barbs into the back surface at an angle to hold the spine in place. An example of such a construction is disclosed in U.S. Pat. No. 3,557,513. Disadvantages of such a spine stem from the manner in which it has been attached. Because of its considerable height, such a spine must be attached only at the site if the panel is to be readily stacked for shipping. The driving of barbs on the site into an aggregate ceiling panel is at best a time-consuming job which, if not done properly, can result in board breakage. At worst, hard aggregate materials such as expanded perlite or vermiculite will not readily permit the barbs to be driven in.

SUMMARY OF THE INVENTION

The disclosure relates to a ceiling panel and ceiling construction in which a reinforcing member is factory-attached to the back side of the panel in such a way as to avoid the shipment of panels having spines projecting upwardly a significant distance from the back surface, and so as to avoid the need for driving fasteners into unslotted panels at the site. More specifically, this is accomplished in one embodiment by the use of a reinforcing member which is pre-secured to the back surface of the panel so as to lie flat thereacross in a manner generally so as to not extend appreciably away from the surface an amount which significantly interferes with the stacking of the panel with other like panels. Once the panel is received at the site, the reinforcing member then is either modified so as to extend, in part, vertically, or it is used in combination with a generally vertically extending beam member. In a second embodiment this is accomplished by preslotting the panel's back surface with a slot positioned between two opposite edges of the body member and extending the full length of the body member, the side walls of the slot being both undercut so as to give the slot the shape of a "T", and further including a beam member comprising a central rib and at least one leg projecting perpendicular therefrom a distance which is less than the undercut of the side walls, the leg being rounded at one outer corner thereof to permit ready insertion of the beam member into the slot.

Accordingly, it is an object of the invention to provide an extra-wide ceiling panel and ceiling constructed therefrom, which panel readily stacks and yet readily accommodates a beam member which may be provided at the site, without the attachment of a plurality of barbs or other fasteners to the body of the panel.

It is a further object of the invention to provide a reinforcing member for such a ceiling panel which may be factory attached, permits flat stacking of the ceiling panels, and which will permit the use of the ceiling panel with a beam member secured to the reinforcing member.

Still another object of the invention is to provide such a ceiling panel and ceiling constructed therefrom wherein a beam member can be secured intermediate the edges of the ceiling panel merely by slipping the beam member into a pre-prepared slot.

Other objects and advantages will become apparent upon reference to the following drawings and detailed discussion.

BRIEF DESCRIPTION OF THE DRAWINGS

FIG. 1 is a fragmentary perspective view of a ceiling assembled from extra-wide panels constructed in accordance with the invention;

FIG. 2 is a fragmentary sectional view in elevation of one embodiment of a ceiling panel of the invention, as it is manufactured and shipped;

FIG. 3 is a fragmentary sectional view identical with that of FIG. 2 except that it illustrates the embodiment ready for assembly in a ceiling;

FIG. 4 is a fragmentary sectional view in elevation similar to FIG. 3, but illustrating an alternate embodiment;

FIG. 5 is a fragmentary sectional view in elevation illustrating yet another embodiment;

FIG. 6 is a fragmentary, transverse sectional view taken along the line VI—VI of FIG. 5;

FIG. 7 is a fragmentary plan view of a portion of the ceiling panel shown in FIGS. 5 and 6;

FIGS. 8 and 9 are fragmentary sectional views in elevation similar to FIG. 5 but illustrating still other embodiments of the invention; and FIG. 10 is a fragmentary plan view of the beam member shown in FIG. 9.

DESCRIPTION OF THE PREFERRED EMBODIMENTS

The invention concerns extra-wide ceiling members commonly known as ceiling panels or tiles, of the lay-in type. By "extra-wide" it is meant a panel the width of which exceeds that which is self-supporting and which, without reinforcement, causes sagging during use. Referring to FIG. 1, ceiling panels 20 are assembled into a ceiling 10 at the building site by laying them onto runners or support members 12, these runners being conventionally supported from the true ceiling by wires (not shown). The runners thus support the panels at the edges of the front surface 22 thereof, side edges 24, 26, 28 and 30 being hidden by the runners. The actual composition of the body 23 of the ceiling panel is conventional and of no consequence to the invention. A representative construction commonly comprises an aggregate of mineral wool, clay, perlite, starch, and various additives.

In accordance with one aspect of the invention, reinforcement of the back surface 32 of such extra-wide panels is provided by treatment of the panel at the factory in such a manner that the panel is still capable of being stacked or "nested" due to its continued flat characteristics. More specifically, it has been found that the back of an extra-wide panel can be reinforced without providing a pre-attached beam which projects so far upwardly from the back surface of the panel that it interferes with the stacking of the panels for shipment or storage.

Turning now more particularly to FIGS. 2 and 3, one embodiment of the invention features a reinforcing member 40 preferably comprising a strip of metal extending longitudinally substantially from one edge to the opposite edge of the panel and which is attached to the back surface by suitable adhesives at a position inbetween the other two edges. As shown in FIG. 1, member 40 extends from edge 28 to edge 30, the long dimension of the panel, and is positioned between edges 24 and 26. However, the construction works just as well if the reinforcing member extends width-wise instead.

A critical aspect of the construction of the member 40 is that, when attached at the factory, it is maintained in a flat condition. Free edge 42 is conventionally rolled over, but this edge extends upwardly from the back surface 32 a distance which is minuscule compared to the width of the member 40. Therefore, as the panel is shipped as shown in FIG. 2, member 40 does not substantially interfere with the stacking of these panels.

In accordance with another aspect of the invention, the member 40 is adhered to the back surface 32 only at that part 46 of the member 40 which extends from one side of a line 44 longitudinally dividing the member into the two sections or parts 46 and 48. Further, the member 40 is preferably weakened along line 44 by means such as a plurality of perforations 50. These perforations in conjunction with part 48 being free of the back surface 32 permit the reinforcing member to be converted or modified at the building site partially into a beam member. Specifically, the part 48 is bent upwardly (arrow 52, FIG. 3) about line 44 so as to extend generally vertically and perpendicularly to the back surface 32.

FIG. 4 illustrates another embodiment of the invention in which the beam member is not an integral part of the reinforcing member, but is removably secured thereto at the site. Parts similar to those previously described bear the same reference numeral to which the distinguishing suffix *a* has been added. As in the previous embodiment, it is not important whether the reinforcing member extends lengthwise or widthwise. Thus, panel 20*a* has secured by adhesives to back surface 32*a*, a reinforcing member 40*a* which is characterized by extending generally flat thereacross. A flange 60 does extend upwardly from the secured part 46*a* of member 40*a*, and therefore from the back surface, but only a distance which is insignificant compared to the total width of member 40*a*. This distance does not substantially interfere with the stacking of the panel. The free end 42*a* of the member is bent over to form a lip which extends generally parallel to the back surface 32*a*. In contrast with the first embodiment, a separate beam member 62 is provided which has a central, vertically oriented, portion 64, and a flange 66 extending from one edge thereof. The flange 66 is especially dimensioned so as to fit between the lip 42*a* and the portion 46*a* of reinforcing member 40*a*. The member 62 is slipped from the dotted position shown, into a secured relationship with the reinforcing member 40*a*, at the site, without the need for driving a fastener into the body 22*a* of the panel.

FIGS. 5 through 7 illustrate yet another embodiment of the invention, wherein the beam member slot secured to the reinforcing member by still another method. Parts similar to those previously described bear the same reference numeral to which the distinguishing suffix *b* has been added. Thus, panel 20*b* has secured to the back surface 32*b* thereof, a reinforcing member 40*b* which is characterized by perforations 50*b* spaced longitudinally therealong. Member 40*b* extends the full length of the panel, as shown in FIG. 7. The back surface 32*b* may be grooved at the factory as shown, to form a slot 70, which slot is aligned with the perforations 50*b* when the member 40*b* is adhered. The entire member 40*b* is attached by suitable adhesives so as to lie flat against back surface 32*b*, thus permitting maximum stacking. A beam member 62*b* is provided which differs from the previous embodiment by means of its edge construction 66*b*. That is, extending from edge 66*b* are projections or teeth 72 which have a longitudinal extension and spacing that accomodates them within the slots 50*b* (FIG. 5). A locking toe portion 74 of each tooth permits the beam member 62*b* to be slid into a locked position, with the toe portion underlying the unperforated portion 75 of member 40*b*. Means are provided to resist rotation of the beam member 62*b* out of the perpendicular position shown in FIG. 6. More specifically, legs are provided along edge 66*b* by lancing and bending tabs 80 and 82 outwardly, each adjacent pair of tabs 80 and 82 being preferably bent outwardly from the same side of the vertical portion 64*b* of member 62*b*, with this side alternating from pair to pair. Thus, adjacent tabs 80 project outwardly from opposite sides of the vertical portion 64*b* (FIG. 6). In this manner, beam member 64*b* is prevented from tipping over when installed. As in the previous embodiments, beam member 62*b* is inserted only at the site so that panel 20*b* can be readily stacked due to the flat nature of member 40*b*.

An alternate construction permissible in some ceiling panels modifies the construction shown in FIGS. 5 and 6 by omitting the slot 70. Teeth 72 must then be of sufficient thickness to permit them to be forced into the panel's back surface. It will be readily apparent that such an arrangement is possible only on panels which are only moderately hard or tough.

The embodiment illustrated in FIG. 8 is a panel in which the beam member is part of the reinforcing member and therefore can be inserted either at the factory or at the site. Parts similar to those previously described bear the same reference numeral to which the distinguishing suffix *c* has been added. Thus, panel 20*c* has a flat reinforcing member 40*c* adhered, by suitable adhesives, at portions 46*c* thereof to the back surface 32*c* of the panel. Projecting from approximately the middle of the bottom of member 40*c* as an integral part thereof is the beam member 48*c*. A slot 70*c* is cut generally perpendicular to the back surface 32*c*, to accommodate the beam member 48*c*. Because member 40*c* projects above back surface 32*c* a distance which is much less than the width of the member, it permits facile stacking of the panels, as in the previous embodiments.

FIGS. 9 and 10 illustrate an embodiment of the invention which reverses the positions of the reinforcing member and beam member shown in FIG. 8. For this reason, the beam member is installed or inserted into the panel at the site only. Parts similar to those previously described bear the same reference numeral to which the distinguishing suffix *d* has been added. Thus, a panel 20*d* has a back surface 32*d* which is generally vertically slotted at 70*d* substantially from one panel edge to the opposite edge. The slot is positioned between the other two edges. Like previous embodiments, the slot may run lengthwise or widthwise. Unlike previous embodiments, slot 70*d* is undercut at 100 and 102 in its opposite side walls, so as to give the slot a shape of an upside-down T which viewed in transverse cross-section, as in FIG. 9. The beam member is complementally shaped to fit in the slot. Specifically it comprises a central rib 48*d* and two legs 104 and 106 projecting generally perpendicular from the rib, the width of the legs being less than the extent of the undercuts so as to permit the legs to fit therewithin as shown. The legs function in a manner similar to the reinforcing member of the other embodiments. Each of the legs 104 and 106 are preferably rounded at at least one end 110, so as to permit the beam member to be readily inserted into the slot 70*d* (FIG. 10).

In all of the above-discussed embodiments, the complementary use of the reinforcing member and the beam member permit extra-wide panels to be hung without any appreciable sag. Panels as large as four feet by eight feet can be so constructed. Even larger panels can be hung if more than one reinforcing member is used in the panel's back surface. It will be readily appreciated that the width of the reinforcing members, shown exaggerated in FIG. 1, is by comparison a very small fraction of the width of the panel, e.g., several inches for the member compared to several feet for the panel. It will also be readily apparent that metal as well as so-called plastic materials can be used in the construction of the reinforcing member and the beam member. A representative example which is in no way limiting is 26 gauge galvanized iron.

Although the invention has been described in connection with certain preferred embodiments, it is not intended that it be limited thereto. Rather, it is intended that it cover all alternative arrangements, embodiments, and equivalent constructions as may be included within the scope of the following claims.

What is claimed is:

1. A reinforced ceiling panel comprising a generally flat sheet having a front surface, a back surface, and opposite edge surfaces;

an elongate reinforcing member extending from one of said edge surfaces to the opposite edge surface between the remaining edge surfaces, said reinforcing member being secured along substantially its entire length flat against said back surface;

and a beam member secured to said reinforcing member so as to project from said back surface, one of said reinforcing member and said beam member being provided with apertures and the other of said members being provided with outwardly extending connecting means for releasably engaging said apertures to connect said members together;

whereby said beam member reinforces said sheet.

2. The panel as defined in claim 1, wherein said connecting means include teeth projecting from the beam member along one edge thereof, of a size and spacing respectively corresponding to that of said apertures.

3. The panel as defined in claim 1, and further including means projecting from at least one side of said beam at one edge thereof for resisting rotation of said beam out of a plane which is perpendicular to said reinforcing member.

* * * * *

UNITED STATES PATENT OFFICE

CERTIFICATE OF CORRECTION

PATENT NO. : 3,965,639

DATED : June 29, 1976

INVENTOR(S) : Edward J. Boarini

It is certified that error appears in the above-identified patent and that said Letters Patent are hereby corrected as shown below:

Column 1, Line 20, delete "751" and insert --2,963,751--;

Column 4, Line 2, delete "slot" and insert --is-- after member.

Signed and Sealed this

Twelfth Day of October 1976

[SEAL]

*Attest:*

RUTH C. MASON
*Attesting Officer*

C. MARSHALL DANN
*Commissioner of Patents and Trademarks*